United States Patent [19]

Martwick et al.

[11] 4,091,735

[45] May 30, 1978

[54] STORED ENERGY IMPACT FUZE

[75] Inventors: Wilford E. Martwick, Minneapolis; John P. Ullrich, St. Paul; Arnum E. Kraemer, Tonka Bay, all of Minn.

[73] Assignee: Honeywell Inc., Minneapolis, Minn.

[21] Appl. No.: 343,445

[22] Filed: Feb. 3, 1964

[51] Int. Cl.[2] ..... F42C 15/22

[52] U.S. Cl. ..... 102/79; 102/70 S; 102/76 P

[58] Field of Search ..... 102/80, 79, 76, 73, 102/78, 71

[56] References Cited

U.S. PATENT DOCUMENTS

| | | | |
|---|---|---|---|
| 770,182 | 9/1904 | Merriam | 102/79 |
| 1,292,505 | 1/1919 | Newell | 102/73 |
| 2,818,812 | 1/1958 | Shenk | 102/80 X |

*Primary Examiner*—David H. Brown

*Attorney, Agent, or Firm*—Albin Medved

[57] ABSTRACT

An improved stored energy impact fuze wherein a spring loaded firing pin is normally restrained in the spring loaded position by a holding mechanism which includes a ball detent positioned in a slot on the firing pin and held in place by a hinged plate. Upon impact, the hinged plate is driven forward allowing the ball detent to move away from the slot on the firing pin, thereby releasing the firing pin. The hinged plate is held in position by a holding pin which lies between the plate and a rotor carrying a detonator. The fuze is activated by rotating the rotor so as to place the detonator in line with the firing pin. In its activated position, a hole in the rotor is also lined up with the holding pin. Upon impact, the holding pin is allowed to move into the hole in the rotor, thereby releasing the hinged plate, and in turn releasing the ball detent holding the firing pin.

10 Claims, 4 Drawing Figures

FIG. 1
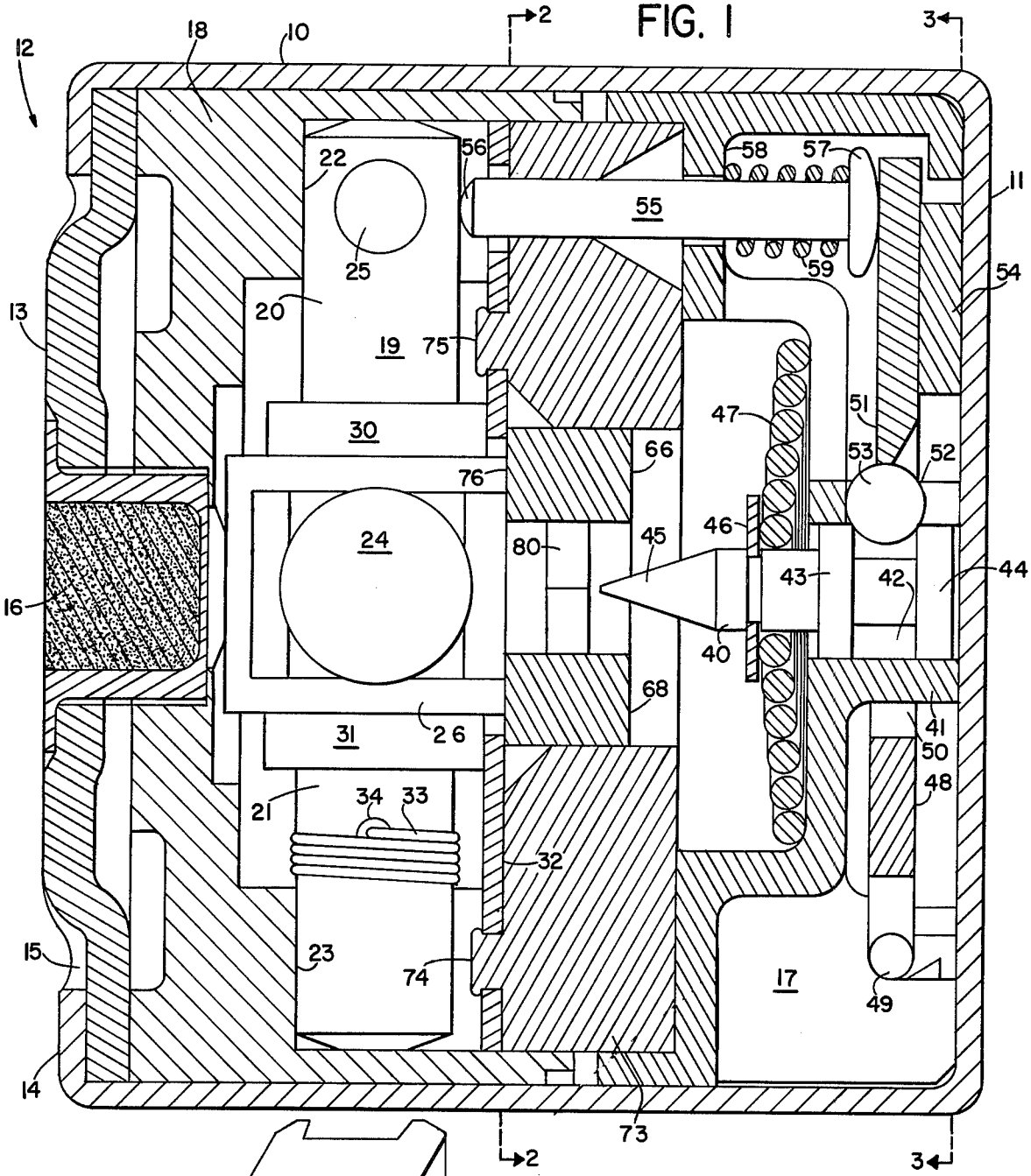
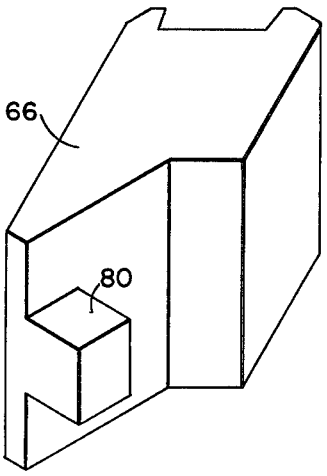
FIG. 4

STORED ENERGY IMPACT FUZE

This invention relates generally to a projectile fuze designed to detonate upon impact and more specifically relates to a stored energy impact sensitive fuze in which a spring loaded firing pin is held in a safe position by an inertial member until the inertial member moves a required distance against a holding spring in response to a predetermined impact force.

Impact fuzes are used in munitions such as artillery projectiles, bombs, and self-propelled rockets to detonate the munition upon impact with a desired target. The fuze when launched is in a safe condition and is normally armed by means responsive to the sudden acceleration resulting from the launch or to the rotation of the projectile during flight. After the fuze is armed, it is designed to detonate upon receiving an impact of sufficient magnitude from a proper direction.

This particular fuze was developed for use in either an anti-personnel projectile, or an anti-material projectile employing a shaped charge. To obtain the most lethal effect from the anti-personnel projectile, the fuze must explode immediately upon impact with the ground in order that fragments of the projectile are driven in all directions for relatively great distances. It is important that the projectile explode prior to becoming buried in the ground. If the projectile becomes buried in the ground before detonation occurs, the anti-personnel effectivenss of the explosion is severely restricted. It is not difficult to design an impact fuze to explode immediately upon impact with a rocky surface or with extremely hard ground but a problem arises where the explosion must occur immediately upon impact with soft ground. The inertial forces resulting from the initial impact with soft ground may be quite small. If these forces are used directly to drive the firing pin into a detonator, they might be too small to cause detonation until the projectile hits rock or other hard object under the surface of the ground.

Two opposite variables must therefore be considered in the design of a fuze which will detonate immediately upon impact with soft ground. The first variable is the amount of force with which the firing pin must be driven into the detonator to achieve reliable operation. The second variable is the amount of inertial force available from an impact which is indicative of the inertial contact with soft ground or other easily penetrated object. These two variables are not compatible since the inertial forces available when detonation is desired might not be sufficient to drive the firing pin at the minimum velocity necessary to achieve detonation.

An important feature of the invention herein thus consists of providing a stored energy fuze in which a spring loaded firing pin is released by a secondary mechanism which includes a mass movable against a second spring upon impact with the ground. The mass and the second spring are constructed such that impact of the projectile with a soft object will cause enough movement to release the spring loaded firing pin. Once released, the firing pin has sufficient stored energy to cause immediate detonation of the projectile.

As previously mentioned, the fuze is also designed for use with a shaped charge projectile. Again the rapid response of this fuze is used to good advantage. In the application of shaped charges, it is important that the charge be at a proper standoff distance from the target when exploded. This standoff is normally provided by igniting the charge as soon as the ogive of the projectile strikes the target. In the case of high speed projectiles, it is important that the fuze responds rapidly to the impact. If it does not, the projectile ogive will crush before the shaped charge is ignited, thereby reducing the standoff distance below an acceptable level. The effectiveness of a shaped charge munition is severely degraded when proper standoff is not maintained. Since this fuze will respond immediately to the initial impact of the projectile ogive with the target, the shaped charge will be ignited before projectile destruction occurs and standoff distance is reduced.

The subject fuze is also extremely safe in that arming of the fuze is accomplished during rotation of the projectile after launch. The stored energy firing pin cannot be released until the fuze is armed. A plurality of interlocking spring loaded detents spin out during rotation of the projectile to allow a detonator to move in line with the firing pin and to unlock the secondary mechanism holding the firing pin. The interlocking feature is unique in that all of the detents must move outwardly in unison to arm the fuze. A lug on each detent is interlocked with lugs on the remaining detents such that an inertial force applied from a single direction cannot cause arming of the fuze.

The design of the fuze is also desirable in that relatively few moving parts are used, none of which are complicated or delicate in nature. The fuze can thus be manufactured and assembled in large quantities without extensive individual attention.

It is therefore an object of the present invention to provide a mechanical stored energy impact fuze which will not only be sensitive to low order impacts but which also will provide sufficient energy to the firing pin to cause detonation of the projectile.

It is a further object of the present invention to utilize the small amounts of inertial energy received upon impact with a soft target to move a lightly biased seismic mass to in turn release a spring loaded firing pin.

Another object of the present invention is to provide interlocking spring loaded detents to hold a stored energy input fuze in a safe condition until the centrifugal forces developed by the rotating projectile cause the detents to spin out and allow arming of the fuze by rebiasing an arming rotor and a holding pin for a seismic mass.

These and other objects of the present invention will become evident from the following description, taken in conjunction with the accompanying drawings, in which:

FIG. 1 is a sectional side view of the subject stored energy impact fuze.

FIG. 4 is an isometric view of one of the interlocking detents disclosed in FIG. 2.

Figure 2:
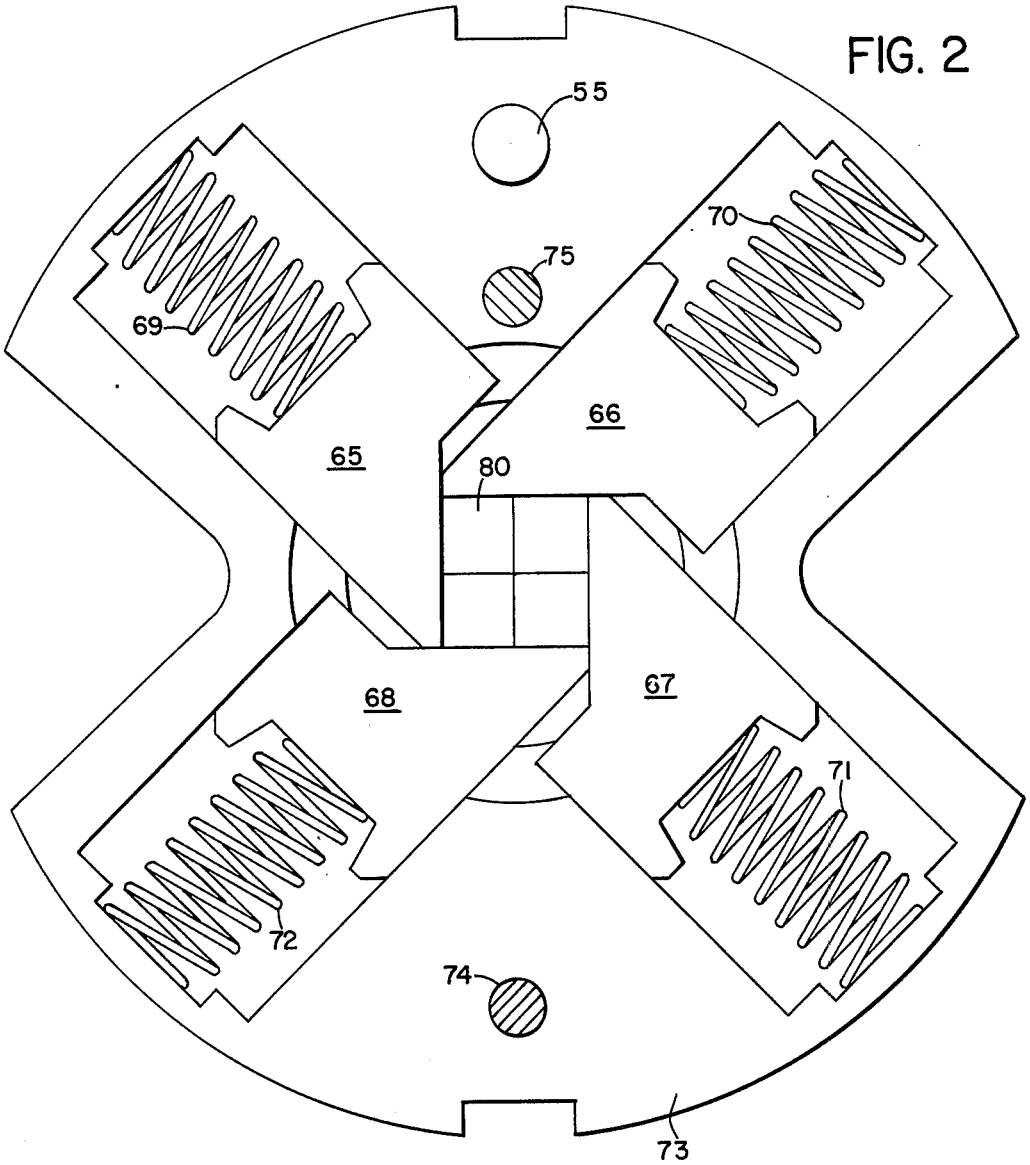
FIG. 2 is a side view of the interlocking spring loaded detents taken along line 2—2 of FIG. 1.

Refer now to the drawings for a more detailed description of the subject invention. In FIG. 1, the various components of the fuze are disclosed in detail in a sectional side view taken along the longitudinal flight axis of the projectile in which this fuze would be mounted. The elements of the fuze are contained within a cylindrical housing 10 having a closed end 11 and an open end 12 into which the various fuze components are successively inserted during assembly of the fuze. After the elements are inserted, open end 12 is closed by a circular cover 13 which is firmly held in place by the crimped edges 14 of container 10. To prevent moisture leakage into the container, the annular junction between housing 10 and cover 13 is filled with a potting compound as at 15. Mounted securely in the center of cover 13 is a lead cup 16 which is filled with an explosive substance such as RDX. The purpose of lead cup 16 is to initiate the explosion of the main explosive charge carried by the projectile after the lead cup itself is ignited by the detonator carried within the fuze.

Cylindrical housing 10 defines a chamber 17 within which the various fuze elements are mounted. Mounted within chamber 17 in a suitable frame 18 is a rotor or carrier member 19. Rotor 19 is mounted perpendicular to the flight or longitudinal axis of the projectile and is rotatable about its own longitudinal axis. The two ends 20 and 21 of rotor 19 are of circular cross-section and are journaled for rotation against frame 18 as at 22 and 23. Bearing surfaces 22 and 23 prevent movement of rotor 19 in a generally forward direction (to the left in FIG. 1). Midway between the ends of rotor 19 is a built up generally cubical section 26 which carries a detonator 24. On either side of cubical center section 26, is a section of the rotor having an increased diameter as at 30 and 31. Sections 30 and 31 also have a circular section and are journaled against a divider member 32 to provide bearing surfaces and to prevent movement of rotor 19 in a rearward direction. Rotor 19 is thus free to rotate about its own longitudinal axis but is allowed no longitudinal or lateral movement. A coiled spring 33 is used to provide power to rotate the rotor 19 once it is released. One end of spring 33 is connected to a hole 34 in rotor 19 while the other end is connected to frame 18.

Mounted at the rear of chamber 17 adjacent end 11 is an elongated firing pin 40 which is mounted within a tubular guide member 41. Guide member 41 forms an open bore 42 which is in line with detonator 24 and lead cup 16. Attached to the rearward portion of firing pin 40 are a pair of annular flange members 43 and 44 having an outside diameter equal to the inside diameter of bore 42. Flange members 43 and 44 thus guide the longitudinal movement of firing pin 40 within bore 42. A pointed end 45 of firing pin 40 extends from bore 42 in line with detonator 24.

Mounted adjacent pointed end 45 is a third flange member 46 which acts to restrain a coiled firing pin spring 47 against tubular member 41.

Figure 3:
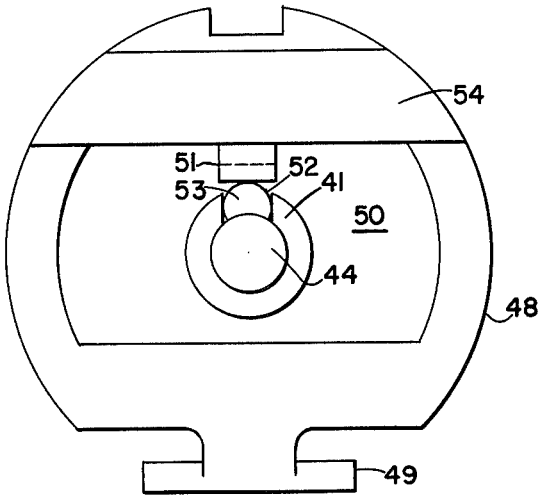
FIG. 3 is a scaled down side view of the hinged flapper plate, firing pin, and ball detent assembly taken along line 3—3 of FIG. 1.

Also mounted at the rear of chamber 17 is a siesmic mass in the form of a flat flapper plate 48. Flat plate 48 is hinged to end 11 at 49. As seen in FIG. 3 flat plate 48 has a generally circular configuration and enjoys limited movement in a forward direction about hinge 49 from the position shown in FIG. 1. An opening 50 is formed within the central area of flat plate 48. Flat plate 48 is mounted with the fuze such that guide member 41 extends through opening 50. Attached to flat plate 48 and extending into opening 50 is a holding member 51. As shown in FIG. 1, holding member 51 extends to a point adjacent the outside surface of guide member 41.

Formed in guide member 41 adjacent holding member 51 is a circular slot 52 in which is mounted a ball detent 53. In the rest position of flat flapper member 48 disclosed in FIG. 1, holding member 51 engages ball detent 53 to hold the ball in slot 52. Ball detent 53 extends into bore 42 between flange member 43 and 44 to prevent firing pin from moving out of bore 42. It thus can be seen that the firing pin will be released and propelled toward detonator 24 by firing pin spring 47 only after ball detent 53 is removed from between flanges 43 and 44. Ball detent 53 can escape from slot 52 only if flapper member 48 moves forward about hinge 49 in a manner to be described later.

In FIG. 1 flapper plate 48 is held in a rest position against end 11 by a holding pin 55. One end 56 of holding pin 55 abuts end 20 of rotor 19. The other end 57 of holding pin 55 abuts flapper plate 48 at a point generally opposite hinge 49 with respect to opening 50. Since holding pin 55 cannot move in either direction, flapper plate 48 is held firmly in the rest position. End 57 is formed as an annular collar having a larger diameter than the holding pin itself. Mounted between collar 57 and a section of the frame 58 is a coiled spring 59. Even after the obstruction of the rotor is removed, holding pin 55 is biased against flapper member 48 by spring 59.

The rotor 19 is normally held in the safe position shown in FIG. 1 with the detonator out of line with the firing pin by a set of spring loaded detents disclosed in detail in FIG. 2. The four detents 65, 66, 67, and 68 are mounted in a plane perpendicular to the flight or longitudinal axis of the projectile so that they will spin out against their restraining springs 69, 70, 71 and 72 after the projectile achieves a predetermined rotational velocity. The detents are all mounted within a housing 73 which in turn is firmly connected to divider member 32 by rivets 74 and 75. Under the influence of centrifugal force each detent moves into a corresponding chamber in housing 73 so that the center of the fuze between the rotor and the firing pin is completely open. Under normal conditions as shown in FIG. 2, the upper flat surfaces of each of the detents rest against the flat surface 76 of rotor 19. The rotor is thus locked in the position shown in FIG. 1. After the detents spin out, the rotor is free to rotate under the influence of coil spring 33 to place detonator 24 in line with firing pin 40 and lead cup 16. After the rotor has moved to this armed position, an extension (not shown) of cubical center portion 26 of rotor 19 moves into postion to prevent the detents from returning to their normal position as shown in FIG. 2.

FIG. 4 discloses an isometric view of detent 66. Extending from the end of detent 66 is a lug 80. Each of the detents is formed in exactly the same manner. As can be seen in FIG. 2 the four lugs interlock to tie the detents together. If the fuze is dropped, for example, an inertial force may result which will tend to move one detent away from the center. Because of the interlocking action, one detent cannot move outwardly from the center unless the others also move. Because of this lug feature, the detents can move outwardly only when each detent is acted upon by an equivalent inertial force. This occurs when the munition is rotating during flight.

After the detents move out during flight and rotor 19 rotates 90° to place the detonator 24 in line with firing pin 40, a circular hole 25 in end 20 of rotor 19 is placed in line with holding pin 55. Holding pin 55 is thus free to move into hole 25 when spring 59 is released.

OPERATION

Prior to launch of the munition in which this fuze is mounted, the fuze is in the condition shown in FIG. 1. The spring loaded detents are locked together as shown in FIG. 2 to hold the rotor in the safe position. If the fuze is dropped, the detents will not separate and if the firing pin should break loose, it cannot reach the detonator since the detonator is out of line, and the lugs on the detent block the firing pin. After the munition is launched and the proper rotational velocity achieved, the four detents will simultaneously unlock and move to their unlocked position adjacent the periphery of housing 10. When the detents move out from the center, rotor 19 is no longer blocked and is free to rotate under the influence of driving means or spring 33. Rotor 19 then snaps to the armed position with detonator 24 in line with firing pin 40 and with slot 25 in line with holding pin 55. As previously mentioned, an extension on the cubical portion 26 of rotor 19 moves into the center between the detents to prevent them from returning to their original position. At this point the fuze is armed but the firing pin is still locked in the position shown in FIG. 1.

Upon impact of the projectile with a target in a generally forward direction, flapper member 48, through inertia, tends to continue in a forward direction against holding pin 55. When sufficient inertial force is received to overcome holding spring 59, flapper member 48 will move forward pushing holding pin 55 into hole 25. This movement of flapper member 48 will release ball detent 53 to in turn to release firing pin 40. Heavy compressed spring 47 will then drive firing pin 40 into detonator 24 to initiate an explosion. It can be seen that once the firing pin is released, it will always impact with the detonator at a velocity determined by firing pin spring 47. This velocity is dependent of the inertial forces created upon impact.

The amount of inertial force necessary to release the firing pin is determined by the tension of holding spring 59 and the mass of flapper member 48. Holding spring 59 and the mass of flapper member 48 can be selected in advance in order to respond to any desired level of impact force. Since there is virtually no friction between flapper member 48 and ball detent 53, it does not affect the operation of the device. In this particular embodiment of the fuze, an extra member 54 has been mounted on the rear of flapper member 48 to increase the mass of the flat flapper member. It also acts as a stop to hold the flapper member in the rest position as in FIG. 1.

From the above description it would be apparent that I have invented a new and unique stored energey impact fuze. Although the form of the invention described herein constitutes the preferred embodiment, it will be understood that changes may be made within the spirit of the invention limited only by the scope of the appended claims.

We claim as our invention:

1. An impact fuze for a rotating projectile, comprising: a housing having a chamber therein; a rotor mounted within said chamber and rotatable about an axis between a safe position and an armed position; said rotor having at least one flat surface formed thereon lying generally in parallel with said axis; spring loaded detent means mounted in said chamber and engageable with said flat surface to hold said rotor in said safe position; said detent means moving outward in response to the centrifugal force developed by the rotation of said projectile to release said rotor; a coiled spring connected between said rotor and said housing for driving said rotor from said safe position to said armed position; a detonator mounted on said rotor for rotation with said rotor to a safe position or an armed position; a tubular guide member mounted in said chamber having an open bore therein in line with said detonator in said armed position; an elongated firing pin having a rearward portion slidably mounted in said bore and having a pointed end extending therefrom; a first annular flange member mounted on said firing pin adjacent said pointed end; a coiled firing pin spring mounted around said pin between said first flange member and said tubular member to bias said pin toward said detonator; a pair of spaced apart annular flange members mounted on said rearward portion of said firing pin, each of said pair of flange members having an outside diameter corresponding to the inside diameter of said bore to thereby guide the longitudinal movement of said firing pin in said bore; a flat plate having a generally central opening formed therethrough and being hinged at one edge to said housing in said chamber in a position to allow said tubular member to protrude through said opening; a holding pin slidably mounted in said housing and having a first end abutting said rotor with said rotor in said safe position and a second end abutting said flat plate at a point generally opposite said hinged edge with respect to said opening to hold said flat plate in a rest position adjacent said housing; said rotor having an opening therein in line with said housing pin in said armed position; said holding pin having an annular collar mounted at said second end; an impact spring mounted around said holding pin between said housing and said collar to normally bias said holding pin against said flat plate; said tubular member having a circular slot formed therein adjacent an edge of said opening in said flat plate with said flat plate in said rest position; and a ball detent mounted in said slot and extending into said bore between said pair of flange members on said firing pin; said edge of said opening in said flat plate bearing against said ball detent to hold said ball detent in position to retain said firing pin in said bore against the bias of said firing pin spring; said firing pin being released after the occurence of an impact having sufficient magnitude to cause said flat plate to compress said impact spring and thereby move from said rest position to release said ball detent.

2. An impact fuze for a rotating projectile, comprising: a housing having a chamber therein; a rotor mounted within said chamber and rotatable about an axis between a safe position and an armed position; a plurality of spring loaded interlocking detents mounted radially around the interior of said chamber in a plane perpendicular to the line of flight of said projectile and engagable with said rotor to hold said rotor in said safe position; said detents unlocking and spinning out to release said rotor in response to an equal centrifugal force applied to each detent by the rotation of said projectile during flight; spring means connected between said rotor and said housing for driving said rotor from said safe position to said armed position after release by said detents; a detonator mounted in said rotor; a tubular member mounted in said chamber having an open bore therein in line with said detonator with said rotor in said armed position; a firing pin having a rearward portions slidably mounted in said bore and having a pointed end extending therefrom; a first flange member mounted on said firing pin adjacent said pointed end; a firing pin spring mounted around said pin between said first flange member and said tubular member to bias said pin toward said detonator; a pair of spaced apart flange members mounted on said rearward portion of said firing pin; a flat plate having a generally central opening formed therethrough and being hinged at one edge to said housing in said chamber in a position to allow said tubular member to protrude through said opening: a holding pin slidably mounted in said housing and having a first end abutting said rotor with said rotor in said safe position and a second end abutting said flat plate to hold said flat plate in a rest position adjacent said housing; said rotor in said armed position having an opening therein in line with said holding pin; said holding pin having an annular collar at said second end; an impact spring mounted around said holding pin between said housing and said collar to normally bias said holding pin against said flat plate to hold said flat plate in said rest position; said tubular member having a circular slot formed therein adjacent an edge of said opening in said flat plate with said flat plate in said rest position; and a ball detent mounted in said slot and extending into said bore between said pair of flange members on said firing pin; said edge of said opening in said flat plate bearing against said ball detent to hold said ball detent in position between said flange members to retain said firing pin in said bore against the bias of said firing pin spring; said firing pin being released upon an impact causing said flat plate to compress said impact spring by driving said holding pin into said opening in said rotor, and thereby move from said rest position to release said ball detent.

3. An impact fuze for rotating projectile, comprising: a housing having a chamber therein; a rotor mounted within said chamber and rotatable about an axis between a safe position and an armed position; spring loaded detent means mounted in said chamber and engagable with said rotor to hold said rotor in said safe position and to release said rotor in response to the centrifugal force developed by the rotation of said projectile; spring means connected between said rotor and said housing for driving said rotor from said safe position to said armed position; a detonator mounted in said rotor; a tubular member mounted in said chamber having an open bore therein in line with said detonator in said armed position; a firing pin having a rearward portion slidably mounted in said bore and having a pointed end extending therefrom; a first flange member mounted on said firing pin adjacent said pointed end; a firing pin spring mounted around said pin between said first flange member and said tubular member to bias said pin toward said detonator; a pair of spaced apart flange members mounted on said rearward portion of said firing pin, a flat plate having a generally central opening formed therethrough and being hinged at one edge to said housing in said chamber in a position to allow said tubular member to protrude through said opening; a holding pin slidably mounted in said housing and having a first end abutting said rotor with said rotor in said safe position and a second end abutting said flat plate to hold said flat plate in a rest position adjacent said housing; said rotor having an opening therein in line with said holding pin in said armed position; said holding pin having an annular collar mounted at said second end; an impact spring mounted around said holding pin between said housing and said collar to normally bias said holding pin against said flat plate; said tubular member having a circular slot formed therein adjacent an edge of said opening in said flat plate with said flat plate in said rest position; and a ball detent mounted in said slot and extending into said bore between said pair of flange members on said firing pin; said edge of said opening in said flat plate bearing against said ball detent to hold said ball detent in position between said flange members to retain said firing pin in said bore against the bias of said firing pin spring; said firing pin being released upon an impact causing said flat plate to compress said impact spring and thereby move from said rest position to release said ball detent;

4. An impact fuze, comprising: a housing, a rotor mounted within said housing and rotatable about an axis between a safe position and an armed position; means mounted in said housing and engageable with said rotor to hold said rotor in said safe position and to release said rotor prior to impact; driving means connected between said rotor and said housing for driving said rotor from said safe position to said armed position; detonating means mounted in said rotor; a tubular member mounted in said housing having an open bore therein in line with said detonating means in said armed position; a firing pin having a rearward portion slidably mounted in said bore and having a pointed end extending therefrom; a first flange member mounted on said firing pin adjacent said pointed end; a firing pin spring mounted between said first flange member and said tubular member to bias said pin toward said detonating means; a pair of spaced apart flange members mounted on said rearward portion of said firing pin, a movable flapper plate having a generally central opening formed therethrough and being hinged at one edge in said housing in a position to allow said tubular member to protrude through said opening; a holding pin slidably mounted in said housing and having a first end abutting said rotor and a second end abutting said flapper plate to hold said plate in a rest position; said rotor having an opening therein through which said holding pin is movable in said armed position; said holding pin having a collar mounted at said second end; an impact spring mounted between said housing and said collar to bias said holding pin against said plate to to hold said plate in said rest position; said tubular member having a slot formed therein adjacent an edge of said opening in said plate with said plate in said rest position; and a ball detent mounted in said slot and extending into said bore between said pair of flange members on said firing pin; said edge of said opening in said plate bearing against said ball detent to hold said ball detent in position between said flange members to retain said firing pin in said bore against the bias of said firing pin spring; said firing pin being released to initiate said detonating means upon an impact which causes said plate to move from said rest position thereby compressing said impact spring and releasing said ball detent.

5. An impact fuze, comprising: a housing; a carrier member mounted within said housing and movable between a safe position and an armed position; means for holding said carrier member in said safe position and for releasing said carrier member prior to impact; means for driving said carrier member from said safe position to said armed position after release; a detonator mounted in said carrier member; a guide member mounted in said housing having a chamber therein with a first open end in line with said detonator in said armed position and a second closed end opposite said chamber therefrom; an elongated firing pin having a rearward portion slidably mounted in said chamber and having a pointed end extending from said first end; a first flange member mounted on said firing pin adjacent said pointed end; a firing pin spring mounted between said first flange member and said guide member to bias said pin toward said detonator; a pair of spaced apart flange members mounted on said rearward portion of said firing pin, each of said pair of flange members having outside dimensions corresponding to the inside dimensions of said chamber thereby to guide the longitudinal movement of said firing pin in said chamber; an impact responsive flapper member having a generally central opening formed therethrough and being hinged at one edge to said housing in a position to allow said guide member to protrude through said opening; a holding pin slidably mounted in said housing and having a first end abutting said carrier member and a second end abutting said flapper member at a point generally opposite said hinged edge with respect to said opening to hold said flapper member in a rest position; said carrier member having an opening therein in line with said holding pin in said armed position; said holding pin having a collar mounted at said second end; an impact spring mounted between said housing and said collar to normally bias said holding pin against said flapper member; said guide member having a slot fromed therein adjacent an edge of said opening in said flapper member with said flapper member in said rest position; and detent means mounted in said slot and extending into said chamber between said pair of flange members on said firing pin; said edge of said opening in said flapper member bearing against said detent means to hold said detent means in position to retain said firing pin in said chamber against the bias of said firing pin spring; said firing pin being released after the occurrence of an impact having sufficient magnitude to cause said flapper member to compress said impact spring and thereby move from said rest position to release said detent means.

6. An impact fuze, comprising: a housing; a carrier member mounted within said housing and movable between a safe position and an armed position; means for holding said carrier member in said safe position and for releasing said carrier member prior to impact; means for driving said carrier member from said safe position to said armed position after release; a detonator mounted in said carrier member; a guide member mounted in said housing having a chamber therein with a first open end in line with said detonator in said armed position and a second closed end opposite said chamber therefrom; an elongated firing pin having a rearward portion mounted in said chamber so as to be longitudinally movable therein and having an actuating end extending from said first end; a first flange member mounted on said firing pin adjacent said actuating end; a firing pin spring mounted between said first flange member and said guide member to bias said pin toward said detonator; a second flange member mounted on said rearward portion of said firing pin and having outside dimensions corresponding to the inside dimensions of said chamber to thereby guide the longitudinal movement of said firing pin in said chamber; an impact responsive flapper member having an opening formed therethrough and being hinged at one edge to said housing in a position to allow said guide member to protrude through said opening; a holding pin slidably mounted in said housing and having a first end abutting said carrier member and a second end abutting said flapper member to hole said flapper member in a rest position; said carrier member having an opening therein in line with said holding pin in said armed position; said holding pin having a collar mounted at said second end; an impact spring mounted between said housing and said collar to normally bias said holding pin against said flapper member; said guide member having a slot formed therein adjacent an edge of said opening in said flapper member with said flapper member in said rest position; and detent means mounted in said slot and extending into said chamber so as to lie between said second flange member on said firing pin and said first open end; said edge of said opening in said flapper member bearing against said detent means to hold said detent means in position to retain said firing pin in said chamber against the bias of said firing pin spring; said firing pin being released after the occurrence of an impact having sufficient magnitude to cause said flapper member to compress said impact spring and thereby move from said rest position to release said detent means.

7. An impact fuze, comprising: a housing, detonating means mounted in said housing; a guide member mounted in said housing having an open bore therein in line with said detonating means; a firing pin having a rearward portion slidably mounted in said bore and having a pointed end extending therefrom; a first flange member mounted on said firing pin adjacent said pointed end; a firing pin spring mounted between said first flange member and said guide member to bias said pin toward said detonating means; a pair of spaced apart flange members mounted on said rearward portion of said firing pin, a movable flapper plate having a generally central opening formed therethrough and being hinged at one edge in said housing in a position to allow said guide member to protrude through said opening; a holding pin slidably mounted in said housing and having a flanged end abutting said flapper plate; an impact spring mounted between said housing and said flanged end to bias said holding pin against said plate to hold said plate in a rest position; said guide member having a slot formed therein adjacent an edge of said opening in said plate with said plate in said rest position; and a ball detent mounted in said slot and extending into said bore between said pair of flange members on said firing pin; said edge of said opening in said plate bearing against said ball detent to hold said ball detent in position between said flange members to retain said firing pin in said bore against the bias of said firing pin spring; said firing pin being released to initiate said detonating means upon an impact which causes said plate to move from said rest position thereby compressing said impact spring and releasing said ball detent.

8. An impact fuze, comprising: a housing, detonating means mounted in said housing; a guide member mounted in said housing having an open bore therein in line with said detonating means; a spring loaded firing pin having a rearward portion slidably mounted in said bore and having a pointed end extending therefrom; said firing pin having an annular recess formed around the periphery of said rearward portion; a movable flapper plate responsive to inertial forces developed upon impact having an opening formed therethrough and being hinged at one edge in said housing in a position to allow said guide member to protrude through said opening; a spring biased holding pin slidably mounted in said housing and having one end thereof abutting said plate to hold said plate in a rest position; and a ball detent mounted in said slot and extending into said bore; said plate bearing against said ball detent to hold said ball detent in said recess in said firing pin to retain said firing pin in said bore; said firing pin being released to initiate said detonating means upon an impact which causes said plate to move from said rest position thereby moving said spring biased holding pin and releasing said ball detent.

9. An impact fuze, comprising: a housing, detonating means mounted in said housing; a guide member mounted in said housing having an open chamber therein in line with said detonating means; a spring loaded firing pin slidably mounted in said chamber; said firing pin having a recess formed therein adjacent a wall of said chamber; a movable flapper plate responsive to inertial forces developed upon impact having an opening formed therethrough and being hinged at one edge in said housing in a position to allow said guide member to protrude through said opening; spring biased holding means mounted in said housing and engaging said flapper plate to hold said plate in a rest position; said guide member having a slot formed therein adjacent said plate with said plate in said rest position; and detent means mounted in said slot and extending into said chamber; said plate bearing against said detent means to hold said detent means in said recess in said firing pin to retain said firing pin in said chamber; said firing pin being released to initiate said detonating means upon an impact which causes said plate to move from said rest position thereby moving said spring biased holding means and releasing said detent means.

10. An impact fuze, comprising: a housing, detonating means mounted in said housing; a guide member mounted in said housing having an open chamber therein in line with said detonating means; resiliently biased firing pin means having a recess formed in an after portion thereof slidably mounted in said chamber; a seismic mass mounted for movement in said housing in response to the inertial forces developed upon impact; resiliently biased holding means mounted in said housing and engaging said seismic mass to hold said mass in a rest position adjacent said guide member; said guide member having a slot formed therein adjacent said seismic mass with said mass in said rest position; and detent means mounted in said slot and extending into said chamber; said mass means bearing against said detent means to hold said detent means in said recess in said firing pin means in said chamber under normal conditions; said firing pin means being released to initiate said detonating means upon an impact which causes said mass to move from said rest position thereby moving said holding means and releasing said detent means.

* * * * *